United States Patent [19]

Church

[11] Patent Number: 4,836,748

[45] Date of Patent: Jun. 6, 1989

[54] RING PROPELLER

[75] Inventor: Leslie G. Church, Knockrow, Australia

[73] Assignee: Church Holdings, Sydney, Australia

[21] Appl. No.: 157,110

[22] Filed: Feb. 10, 1988

Related U.S. Application Data

[63] Continuation of Ser. No. 29,384, Mar. 23, 1987, which is a continuation of Ser. No. 776,051, filed as PCT AU84/00252 on Dec. 5, 1984, Published as W085/02594 on Jun. 20, 1985, abandoned.

[30] Foreign Application Priority Data

Dec. 9, 1983 [AU] Australia ..... PG2788

[51] Int. Cl.[4] ..... B63H 1/16

[52] U.S. Cl. ..... 416/181; 416/189

[58] Field of Search ..... 416/181, 189, 175, 192, 416/203

[56] References Cited

U.S. PATENT DOCUMENTS

| | | | |
|---|---|---|---|
| 677,101 | 6/1901 | Parker | 416/189 R |
| 1,029,907 | 6/1912 | Arnold | 416/181 |
| 1,092,960 | 4/1914 | Taylor | 416/189 R |
| 1,438,012 | 12/1922 | Bauer | 416/181 |
| 1,518,501 | 12/1924 | Gill | 416/189 R |
| 2,213,610 | 9/1940 | Ronning | 416/189 R X |
| 2,396,340 | 3/1946 | Paulson | 416/181 |
| 2,426,742 | 9/1947 | Pawlowski | 416/189 R |
| 3,071,194 | 1/1963 | Geske | 416/193 X |
| 3,508,517 | 4/1970 | Hannan | 115/42 |
| 4,370,096 | 1/1983 | Church | 416/189 |

FOREIGN PATENT DOCUMENTS

| | | | |
|---|---|---|---|
| 40903 | 9/1929 | Denmark | 416/189 R |
| 2934871 | 3/1980 | Fed. Rep. of Germany | 416/189 R |
| 464289 | 6/1951 | Italy | 416/181 |
| 192908 | 2/1923 | United Kingdom | 416/181 |
| 530488 | 12/1940 | United Kingdom | 416/189 R |

*Primary Examiner*—Everette A. Powell, Jr.

*Attorney, Agent, or Firm*—Beveridge, DeGrandi & Weilacher

[57] ABSTRACT

A ring propeller has a frusto-conical shroud disposed co-axially about a boss, and a plurality of blades extending between the boss and the shroud thereby dividing the shroud into equal sectors. The blades have parallel edges and are of constant cross section between the boss and the shroud. The reversing characteristics of the propeller are substantially improved by having a plurality of apertures disposed equally around the shroud and passing through it. There is at least one aperture in each sector, and the apertures are disposed at an angle to the central axis of the propeller of from 2° to 65°. The walls of the apertures are disposed at an angle to the outer surface of the shroud to thrust water on the trailing faces of the blades when the propeller is rotated in a reverse direction.

9 Claims, 4 Drawing Sheets

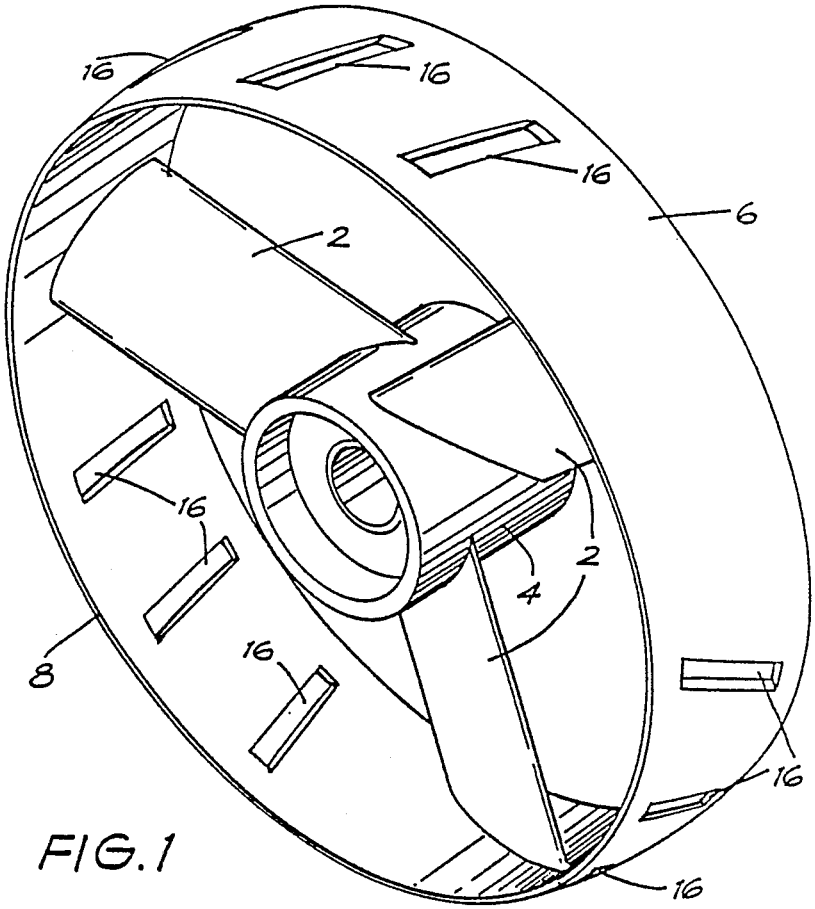
FIG. 1
FIG. 2
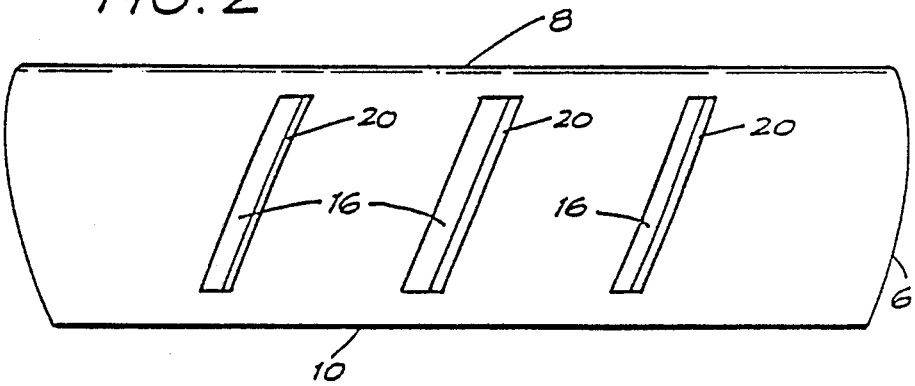

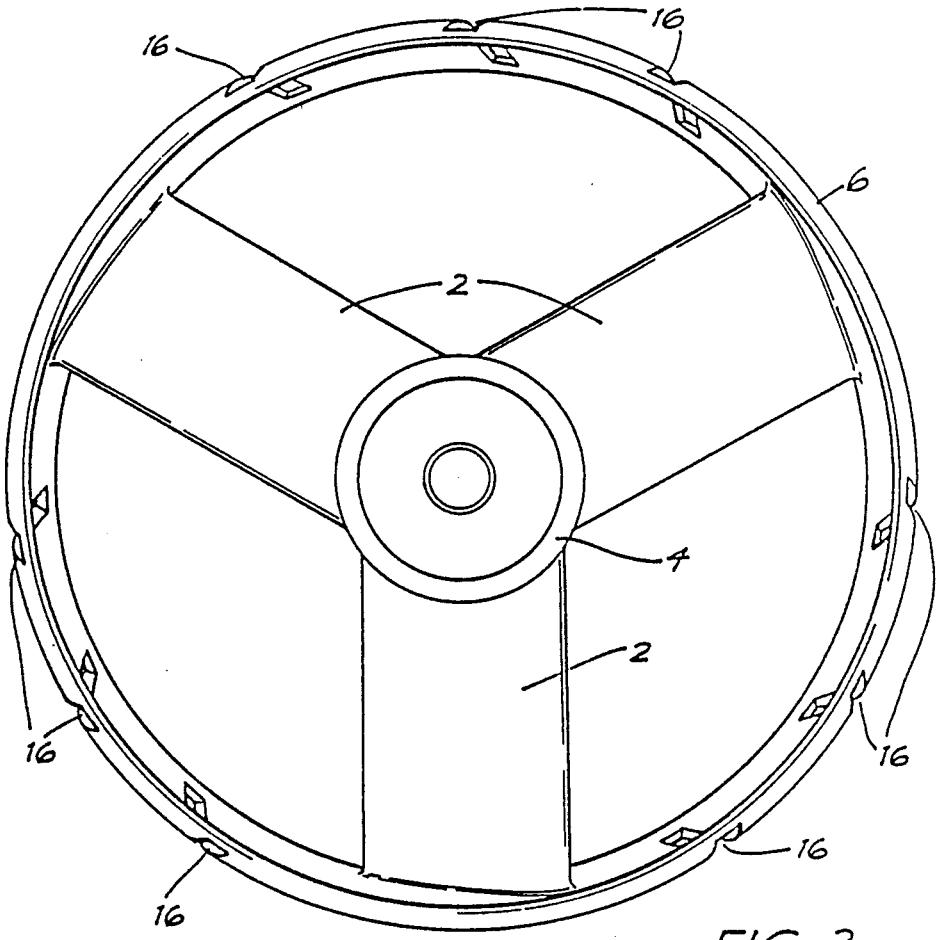
FIG. 3
FIG. 4
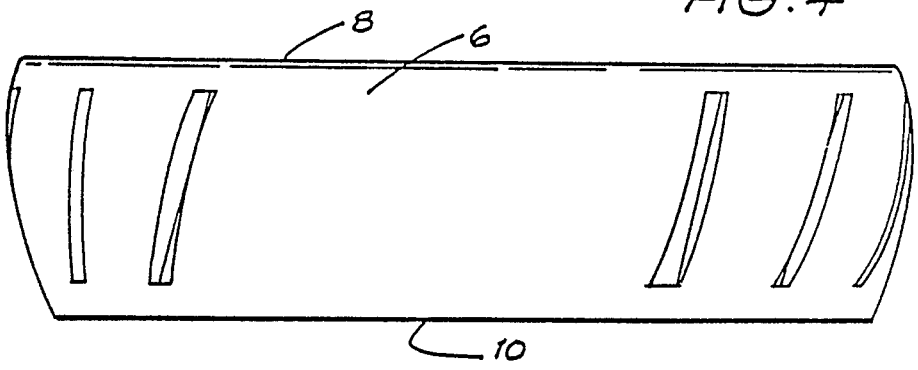

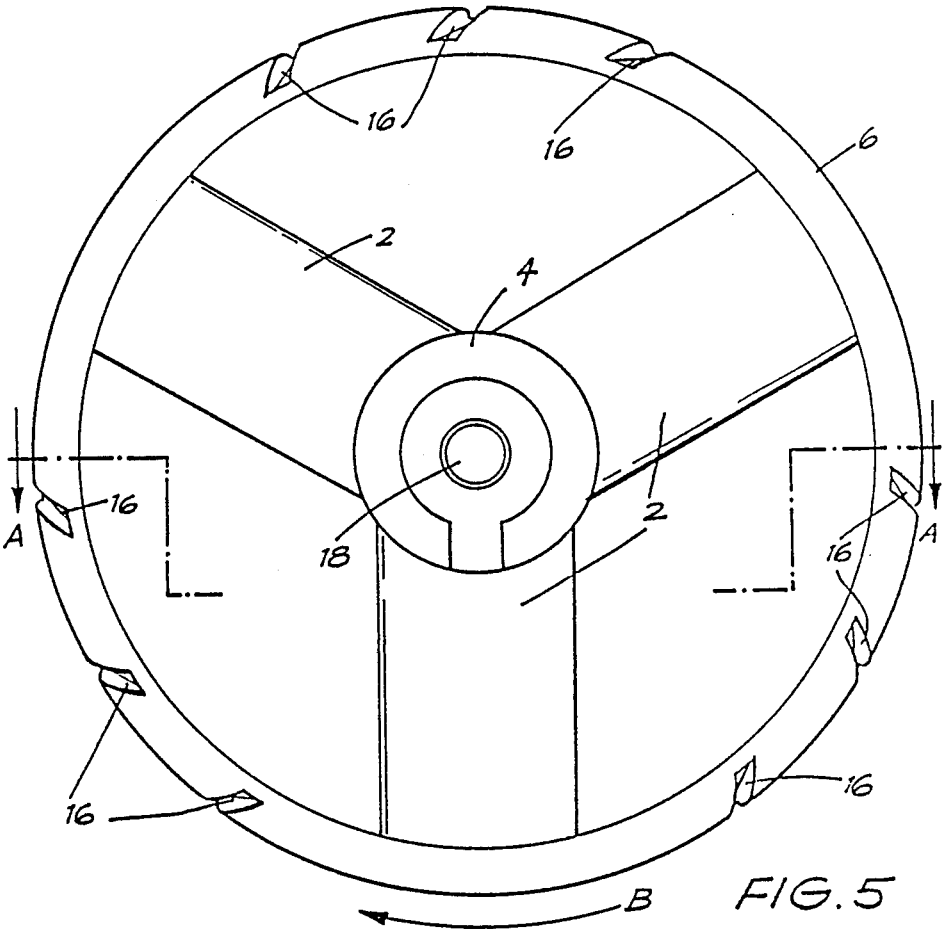
FIG. 5
FIG. 6
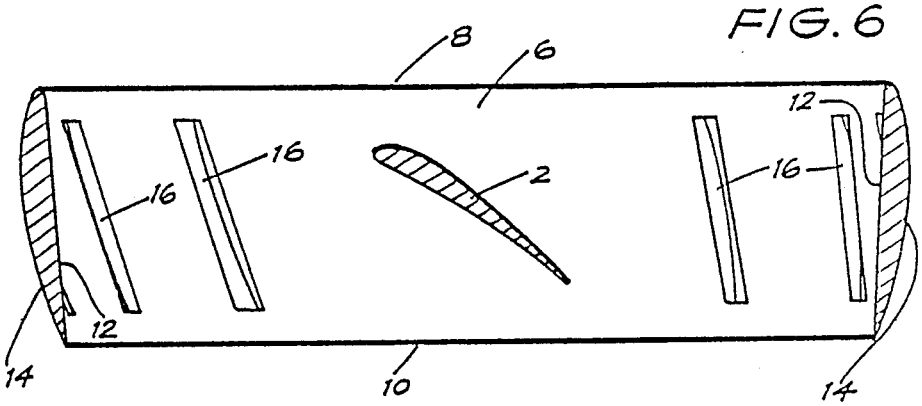

RING PROPELLER

This application is a continuation of application Ser. No. 029,384, filed Mar. 23, 1987, which is a continuation of application Ser. No. 776,051, filed Aug. 7, 1985.

This invention concerns ring propellers.

In U.S. Pat. No. 4,370,096 a metal ring propeller is described which has a hub, three blades of constant width radiating from the hub, mutually at 120°, each of aerofoil section and a frusto-conical wall concentric with the hub to which the outer ends of the blades are fixed such that the blades, in use, propel water through the annular space between the hub and the frusto-conical wall. In that propeller the construction and shape of the frusto-conical wall is subject to various refinements in order to promote efficient flow through the propeller.

Firstly, the inner surface of the frusto-conical wall is that of a frustum with a constant taper from the entry end of the frustum to the exit end thereof. A taper of six degrees with respect to the central axis of the propeller suffices.

The outer surface of the wall is convex giving the wall an aerofoil section and the leading edge of the frusto-conical wall is bevelled on both its inner surface and outer surface. The angle of bevel being less for the outer surface than the inner surface.

Reversal of the direction of rotation of a ring propeller produces reverse thrust but as the pitch of the blades is small compared to a conventional propeller the reverse thrust tends to be poor. This invention seeks to improve the reverse thrust of the above described type of ring propeller.

This invention provides a marine ring propeller comprising a boss, a frusto-conical shroud disposed coaxially about the boss, a plurality of blades extending between the boss and the shroud and thereby dividing the shroud into equal sectors, each blade having parallel edges and being of constant cross-section between the boss and the shroud wherein the shroud is pierced by a plurality of apertures as herein defined which are equally disposed around the shroud, there being at least one aperture per sector, the apertures being disposed at an angle to the central axis of the boss of from 2° to 65° and the shroud being pierced by the apertures at an angle to the periphery of the shroud preferably the angle is from 2° to 65°.

In this specification the term "aperture" means an elongated slot or a group of apertures such as individual bores which are clustered or arranged to act in the same way as a slot. When the aperture is a slot the angle between the rotational axis of the boss and the longitudinal axis of the slot is preferably of the order of 10°. The length of the slot is not thought critical and may be of the order of half the width of the shroud, namely half the dimension from the leading edge to the trailing edge of the shroud.

The position of the slots in relation to these two edges affects the reversing properties of the propeller and it is preferable to place the slots closer to the trailing edge such that the ratio of the front margin to the rear margin is of the order of 2:1. The slots are conveniently rectangular in shape, the ratio of length to width being from 5:1 to 7:1.

The shroud has an inner surface which is frusto-conical and therefore any line upon that surface extending from leading to trailing edge in the direction of flow is straight, whereas the outer surface of the shroud is arcuate to provide an aerofoil section for the shroud. The taper of the frustum may be of the order of 5°-10°.

As the shroud diameter increases the aspect ratio of the aerofoil section diminishes. As the shroud width increases, again the aspect ratio of the aerofoil section diminishes.

One embodiment of the invention will now be described with reference to the accompanying drawings in which:

FIG. 1 is a perspective view of a propeller when viewed from the upstream end;

FIG. 2 is a side view of the propeller illustrated in FIG. 1;

FIG. 3 is a plan view of the propeller;

FIG. 4 is a side view at 60°;

FIG. 5 is an inverted plan view; and

FIG. 6 is a section on line A—A of FIG. 5.

Figure 7:
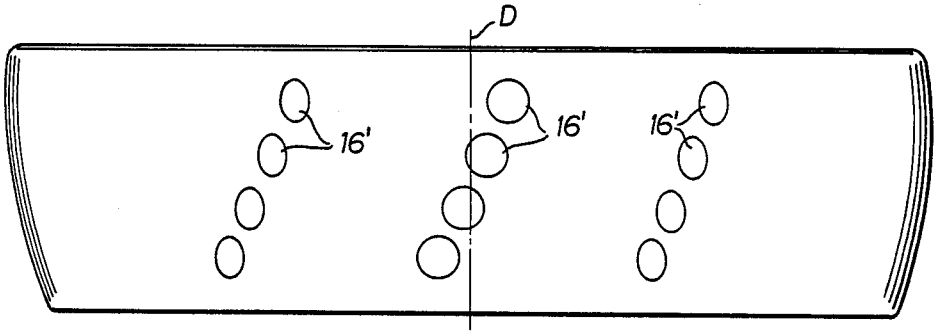
FIG. 7 is a side view of a modified propeller in which the apertures are formed by bores.

Referring now to the drawings, a bronze ring propeller in the embodiment described has three blades, 2 positioned at 120° around a central boss 4. The annular shroud 6 is coaxial with the boss and is connected to the boss by each blade, the whole propeller being an investment casting. The blades 2 are all laid back 10° which places the leading edge 8 of the shroud in the same plane as the boss 4 and the trailing edge 10, just to the rear of the boss 4. Each of the blades 2 are of constant width and of an aerofoil section which is constant between the mutually opposite ends of the blade that is they have a common chord root. The pitch of the blades is 30°. The shroud 6 has a frusto-conical inner face 12 which defines a 10° taper whereas the outer face 14 is a compound arcuate curve giving an aerofoil section. Each of the three sectors of the shroud is pierced by three rectangular slots 16. The slots are spaced equally from one another and from the junctions of the blades with the shroud. The axis of each slot is inclined at about 10° to the axis of rotation 18 of the boss. As mentioned above, the apertures 16 pierce the shroud at an angle which is preferably from 2° to 65° relative to the periphery of the shroud. Since the apertures are so inclined, it will be understood that each aperture has walls which are inclined at an angle relative to a line which extends radially from the central axis of the propeller to the respective aperture.

When the propeller is driving in the forward direction which is indicated by the arrow B in FIG. 5 substantially no water is drawn through the slots 16 however when the propeller is operated in the reverse direction the leading inclined edge 20 of each slot bites into the water and thrusts jets of water on the trailing faces of each blade thereby vastly improving the moving thrust of the propeller.

While the distribution of the slots can be seen in FIG. 1 the inclination of the slots can best be seen in FIG. 2.

In another embodiment shown in FIG. 7, each slot is replaced by a series of several bores 16' each lying at the same angle to the diameter D as the single slot.

While the embodiment described refers to a propeller having three blades with three slots in each sector it will be appreciated that the invention is not so limited.

I claim:

1. A marine ring propeller which has improved characteristics when operated in a reverse direction, comprising;

a boss having a central axis;

a frusto-conical shroud disposed co-axially about the boss, said shroud having an inner surface and an outer surface;

a plurality of blades extending between the boss and the shroud thereby dividing the shroud into equal sectors, each blade having parallel edges, a leading face, a trailing face and being of constant cross-section between the boss and the shroud;

said shroud being pierced by a plurality of apertures which are disposed around the shroud, there being at least one aperture per sector, the apertures extending along the shroud at an angle to the central axis of from 2° to 65 means for thrusting water on the trailing faces of the blades when the propeller is operated in a reverse direction to improve the reverse thrust of the impeller, said means including walls of said apertures, said walls being inclined at an angle relative to a line which extends radially from said central axis to the respective apertures, said walls being inclined in a direction which thrusts water on the trailing faces of the blades when the propeller is operated in a reverse direction.

2. A marine ring propeller as claimed in claim 1 wherein said apertures are elongated slots.

3. A marine ring propeller as claimed in claim 1 wherein said apertures are bores.

4. A marine ring propeller as claimed in claim 1 wherein said apertures are dispersed at an angle to the periphery of the ring of from 2° to 65°.

5. A marine ring propeller as claimed in claim 1 wherein the propeller has three blades and there being three slots in each segment.

6. A marine ring propeller as claimed in claim 2 wherein the angle between the longitudinal axis of the boss and the longitudinal axis of the slot is 10°.

7. A marine ring propeller as claimed in claim 6 wherein the ratio of length to width of the slot is 5:1 to 7:1.

8. A marine ring propeller as claimed in claim 1 wherein the shroud has an inner surface which is frusto-conical and the outer surface of the shroud is arcuate to provide an aerofoil sector.

9. A marine ring propeller as claimed in claim 8 wherein the taper of the frustum is 5° to 10°.

* * * * *